US009829212B2

(12) United States Patent
Im et al.

(10) Patent No.: US 9,829,212 B2
(45) Date of Patent: Nov. 28, 2017

(54) DIFFUSER AND AIR CONDITIONER HAVING THE SAME

(71) Applicant: Samsung Electronics Co., Ltd., Suwon-si (KR)

(72) Inventors: Chang Hoon Im, Seongnam-si (KR); Yong Hyun Kil, Suwon-si (KR); Jung Ho Kim, Suwon-si (KR); Eun Ji Na, Suwon-si (KR); Jin Ho Mok, Seoul (KR); Kil Hong Song, Seoul (KR); Gwang-jun Yu, Seoul (KR); Joon-Ho Yoon, Suwon-si (KR); Seong-Young Jeong, Bucheon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 379 days.

(21) Appl. No.: 14/615,937

(22) Filed: Feb. 6, 2015

(65) Prior Publication Data

US 2015/0241084 A1 Aug. 27, 2015

(30) Foreign Application Priority Data

Feb. 27, 2014 (KR) ..... 10-2014-0023187

(51) Int. Cl.
*F24F 13/08* (2006.01)
*F24F 13/24* (2006.01)

(52) U.S. Cl.
CPC ..... *F24F 13/24* (2013.01); *F24F 13/082* (2013.01); *F24F 2013/242* (2013.01)

(58) Field of Classification Search
CPC .. F24F 13/0218; F24F 2013/242; F24F 13/24; F24F 13/06; F24F 7/10; F24F 13/082; F24F 13/075
USPC ..... 454/906, 301, 262; 181/224, 227, 228
See application file for complete search history.

(56) References Cited

U.S. PATENT DOCUMENTS 1,916,908 A * 7/1933 Lewis ..... E04B 1/84 138/178
6,899,615 B2 * 5/2005 Gebke ..... B01D 46/008 454/306

FOREIGN PATENT DOCUMENTS

JP 57101235 A * 6/1982
JP EP 1455141 A1 * 9/2004 ..... F24F 1/0003

* cited by examiner

*Primary Examiner* — Alissa Tompkins
*Assistant Examiner* — Elizabeth M May
(74) *Attorney, Agent, or Firm* — Staas & Halsey LLP

(57) ABSTRACT

A diffuser which reduces noise generated due to a flow of cool air when the cool air is discharged from a supply duct configured to supply cool air generated from a body provided at outdoors to the indoors, and an air conditioner having the same are provided. The diffuser includes a coupling part coupled to the supply duct, an extension part extending from the coupling part while having a taper shape such that cool air supplied through the supply duct is guided to the indoors, a mesh provided to surround an outer side of the extension part, and a housing accommodating the coupling part and the extension part, and having an opening configured to discharge the cool air supplied to the extension part to the indoors.

20 Claims, 7 Drawing Sheets

DIFFUSER AND AIR CONDITIONER HAVING THE SAME

CROSS-REFERENCE TO RELATED APPLICATIONS

This application claims the priority benefit of Korean Patent Application No. 10-2014-0023187, filed on Feb. 27, 2014 in the Korean Intellectual Property Office, the disclosure of which is incorporated herein by reference.

BACKGROUND

1. Field

Embodiments relate to a diffuser capable of reducing noise generated due to flow of cool air, and an air conditioner having the same.

2. Description of the Related Art

In general, an air conditioner represents an home appliance designed to keep indoor air at a pleasant temperature by using a cooling cycle of refrigerant, and the air conditioner includes an indoor unit provided with a heat exchanger and a blower fan and disposed at indoors, an outdoor unit provided with a heat exchanger, a blower fan, a compressor and a condenser and disposed at an outdoor, and a refrigerant pipe connecting the indoor unit to the outdoor unit to circulate refrigerant.

A general air conditioner generates cool air through heat exchange by the heat exchanger in the indoor unit, and supplies the generated cool air to the indoors. When a large capacity air conditioner is used, the indoor unit is omitted, and the outdoor unit serves as an indoor unit in addition to an outdoor unit of a general air conditioner, and such an air conditioner is referred to as a unitary air conditioner.

A unitary air conditioner generates cool air at the outdoors, and supplies the generated cool air to the indoors through a supply duct.

As for the unitary air conditioner, the indoor unit is omitted, so that the spatial efficiency is enhanced. However, cool air generated at the outdoors is supplied by a supply duct having a narrow width, and when the cool air is discharged at a high speed from the supply duct, noise due to a flow of the cool air may occur.

SUMMARY

In an aspect of one or more embodiments, there is provided a diffuser which is capable of reducing noise generated due to a flow of cool air when the cool air is discharged from a supply duct configured to supply cool air generated from a body provided at outdoors to the indoors at a high speed as the diffuser is coupled to the supply duct, and an air conditioner having the same.

In accordance with an aspect of one or more embodiments, there is provided an air conditioner which includes a body, a supply duct, and a diffuser. The body may be provided outdoors to generate cool air. The supply duct may have one end connected to the body and the other end connected to a diffuser so that the cool air generated from the body is supplied to the indoors through the diffuser. The diffuser may be coupled to the other end of the supply duct to reduce noise generated due to a flow of cool air being discharged to the indoors. The diffuser may include a coupling part coupled to the supply duct, an extension part which extends from the coupling part and which has a taper shape such that cool air supplied through the supply duct is guided to the indoors, a mesh which surrounds an outer side of the extension part, and a housing which accommodates the coupling part and the extension part, and which has an opening configured to discharge the cool air supplied to the extension part to the indoors.

The coupling part may be provided in a hollow cylindrical shape.

The air conditioner may further include an expansion part provided at an inner circumferential surface of the coupling part and configured to expand in a direction of cool air being discharged so that cool air discharged from the supply duct is gradually diffused while passing through the coupling part.

The extension part may include a ring member which has a circular shape having a radius smaller than an inner diameter of the coupling part which is spaced apart from the coupling part, and the extension part includes a plurality of connecting bars which connect the coupling part to the ring member to support the mesh.

The plurality of connecting bars may be spaced apart from each other so that air discharged from the supply duct and guided to the extension part is discharged to the outside of the extension part through gaps between the plurality of connecting bars.

The extension part may have a cross section that decreases along a moving direction of cool air discharged from the supply duct, so that a flow of cool air inside the extension part is uniformly distributed.

As the flow of cool air inside the extension part is uniformly distributed, a speed of cool air discharged from the extension part may be decreased, thereby reducing noise generated when cool air is discharged.

Cool air flowing inside the extension part may be pressurized by the mesh, so that noise due to collision of flow of cool air is reduced.

The housing may include an accommodating part configured to accommodate the extension part, and a cover disposed at a front side of the accommodating part to accommodate the coupling part.

The opening may be provided at the accommodating part, and a discharge grill may be provided at the opening.

The opening may be configured to induce air supplied through the supply duct to be discharged in one direction to the outside of the extension part when the air is discharged to the indoors.

The cover may be provided so that air discharged from the supply duct is transferred to the coupling part while maintaining a constant discharge direction.

The cover may be provided in a vertically bent shape such that air discharged from the supply duct is transferred to the coupling part in a vertically bent direction.

In accordance with an aspect of one or more embodiments, there is provided an air conditioner which includes a body, a supply duct, and a diffuser. The body may be provided outdoors to generate cool air. The supply duct may have one end connected to the body and the other end connected to a diffuser so that the cool air generated from the body is supplied to the indoors. The diffuser may be coupled to the other end of the supply duct to reduce noise generated due to a flow of cool air being discharged to the indoors. The diffuser may include a coupling part, an extension part, a mesh and a housing. The coupling part having a hollow cylindrical shape may be coupled to the supply duct and may be provided with an inner circumferential surface gradually expanding in a direction of cool air discharged, so that cool air discharged from the supply duct is diffused. The extension part may extend from the coupling part and may have a taper shape so that a cross section of the extension part decreases along a moving direction of cool air discharged from the supply duct. The mesh may surround an outer side of the extension part. The housing may have an opening allowing cool air discharged from the extension part to be discharged in one direction.

The coupling part may be provided in a hollow cylindrical shape, and may be provided at an inner circumferential surface thereof with an expansion part to expand in a direction of cool air being discharged such that cool air discharged from the supply duct is gradually diffused while passing through the coupling part.

The extension part may include a ring member provided in a circular shape having a radius smaller than an inner diameter of the coupling part and may be spaced apart from the coupling part, and the extension part may include a plurality of connecting bars which connects the coupling part to the ring member to support the mesh.

Cool air flowing in the extension part may be pressurized by the mesh, so that noise due to collision of flow of cool air is reduced.

The housing may include an accommodating part configured to accommodate the extension part and provided with the opening, and a cover disposed at a front side of the accommodating part to accommodate the coupling part.

In accordance with an aspect of one or more embodiments, there is provided a diffuser coupled to a supply duct configured to discharge cool air to reduce noise generated due to a flow of cool air being discharged from the supply duct includes a coupling part, an extension part, a mesh and a housing. The coupling part may have a hollow cylindrical shape and may be coupled to the supply duct. The extension part may extend from the coupling part and may have a taper shape so that a cross section of the extension part decreases along a moving direction of cool air received from the supply duct. The mesh may be provided to surround an outer side of the extension part. The housing may have an opening configured to discharge cool air discharged from the extension part in one direction.

The coupling part may have a hollow cylindrical shape, and may be provided at an inner circumferential surface thereof with an expansion part to expand in a direction of cool air being discharged so that cool air discharged from the supply duct is gradually diffused while passing through the coupling part.

The extension part may include a ring member which has a circular shape having a radius smaller than an inner diameter of the coupling part and which is spaced apart from the coupling part, and the extension part may include a plurality of connecting bars which connects the coupling part to the ring member to support the mesh.

Cool air flowing in the extension part may be pressurized by the mesh, so that noise due to collision of flow of cool air is reduced The housing may include an accommodating part configured to accommodate the extension part and provided with the opening, and a cover disposed at a front side of the accommodating part to accommodate the coupling part.

As is apparent from the above, noise generated due to a flow of cool air when the cool air is discharged is reduced, and the flow of cool is uniformly distributed.

BRIEF DESCRIPTION OF THE DRAWINGS

These and/or other aspects of embodiments will become apparent and more readily appreciated from the following description of embodiments, taken in conjunction with the accompanying drawings of which.

DETAILED DESCRIPTION

Figure 1:
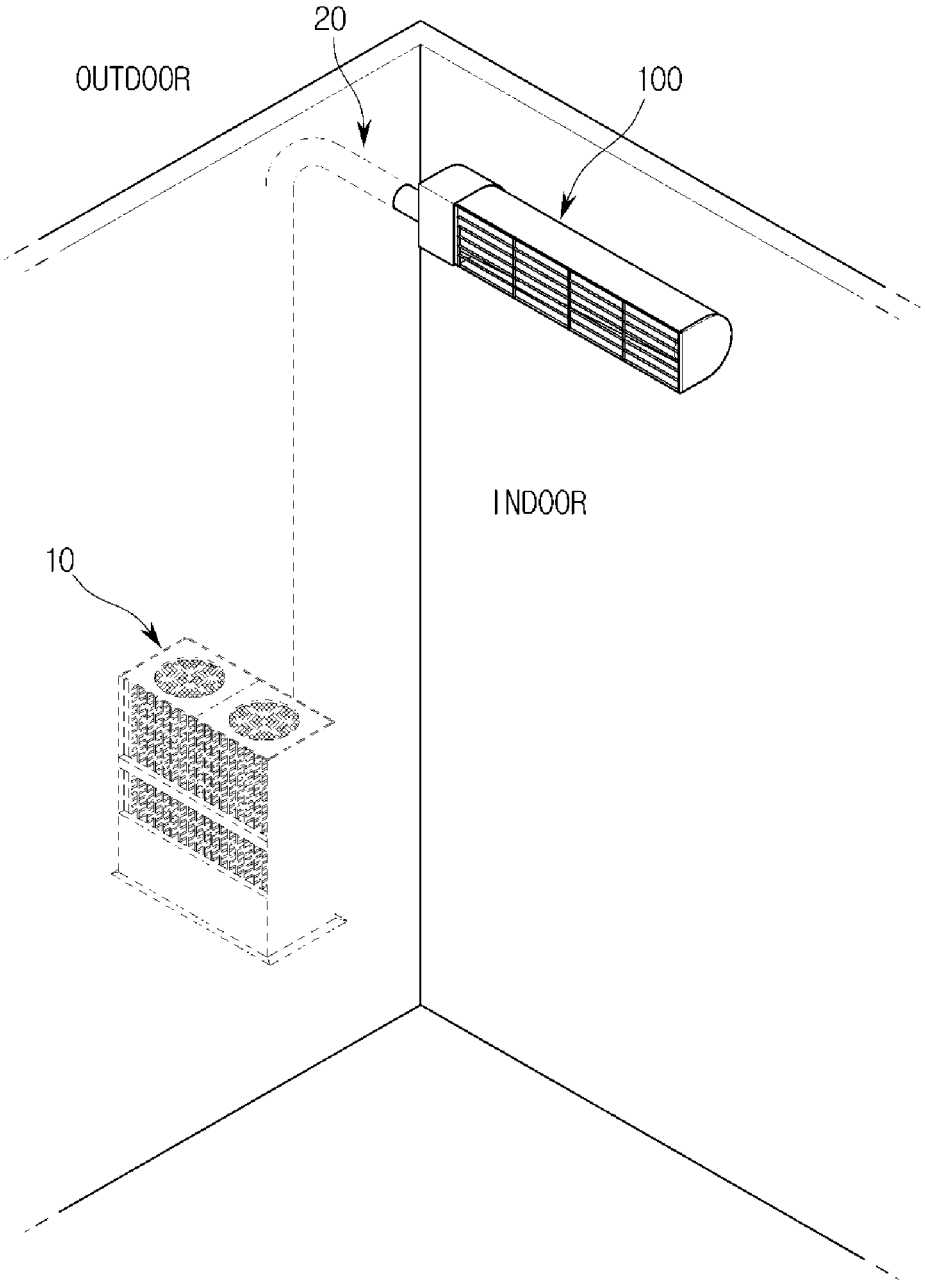
FIG. 1 is a drawing illustrating an air conditioner in accordance with an embodiment.

Reference will now be made in detail to embodiments of the present disclosure, examples of which are illustrated in the accompanying drawings, wherein like reference numerals refer to like elements throughout.

Figure 5:
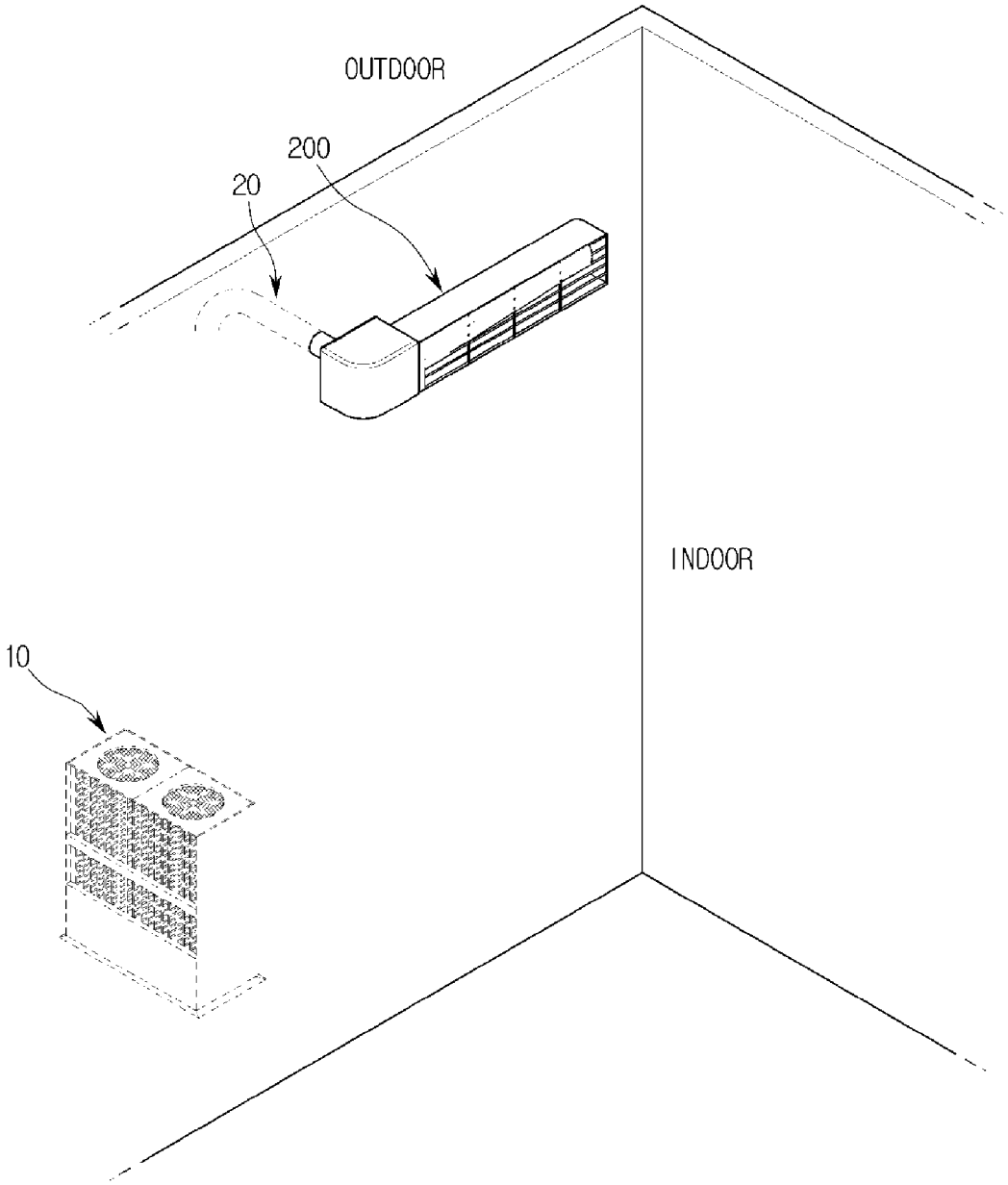
FIG. 5 is a drawing illustrating an air conditioner installed in accordance with an embodiment.

Referring to FIGS. 1 and 5, an air conditioner includes a body 10 provided at outdoors and generating cool air, and a supply duct 20 configured to supply the cool air generated from the body 10 to indoors.

The air conditioner may be a unitary air conditioner in which the body 10 installed at outdoors serves as an outdoor unit installed at outdoors and an indoor unit installed at indoors to supply cool air generated from the body 10 to indoors through the supply duct 20.

Although not shown, apparatuses provided inside the body 10 to generate cool air may include a compressor, a condenser, an expansion valve and an evaporator.

Since cool air is generated from the inside of the body 10 provided at outdoors and then supplied to the indoors the supply duct 20, there is no need of an additional indoor unit at indoors to generate cool air.

The supply duct 20 has one side connected to the body 10, and the other side connected to the indoors, to supply cool air generated from the body 10 to the indoors.

The cool air generated from the body 10 provided at outdoors is directly supplied to the indoors directly through the supply duct 20, so that an indoor space is sufficiently utilized, but when cool air is supplied to the indoors through the supply duct 20 having a narrow width, the cool air is discharged to the indoors at a high speed from the supply duct 20, causing noise.

In order to reduce noise generated due to a flow of cool air discharged to the indoors from the supply duct 20, a diffuser 100 is coupled to the other side of the supply duct 20.

Figure 2:
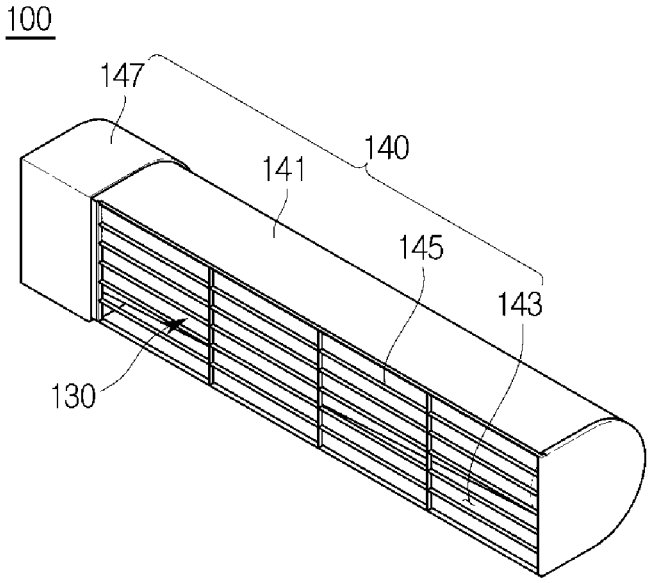
FIG. 2 is a perspective view illustrating a diffuser in accordance with an embodiment.
Figure 3:
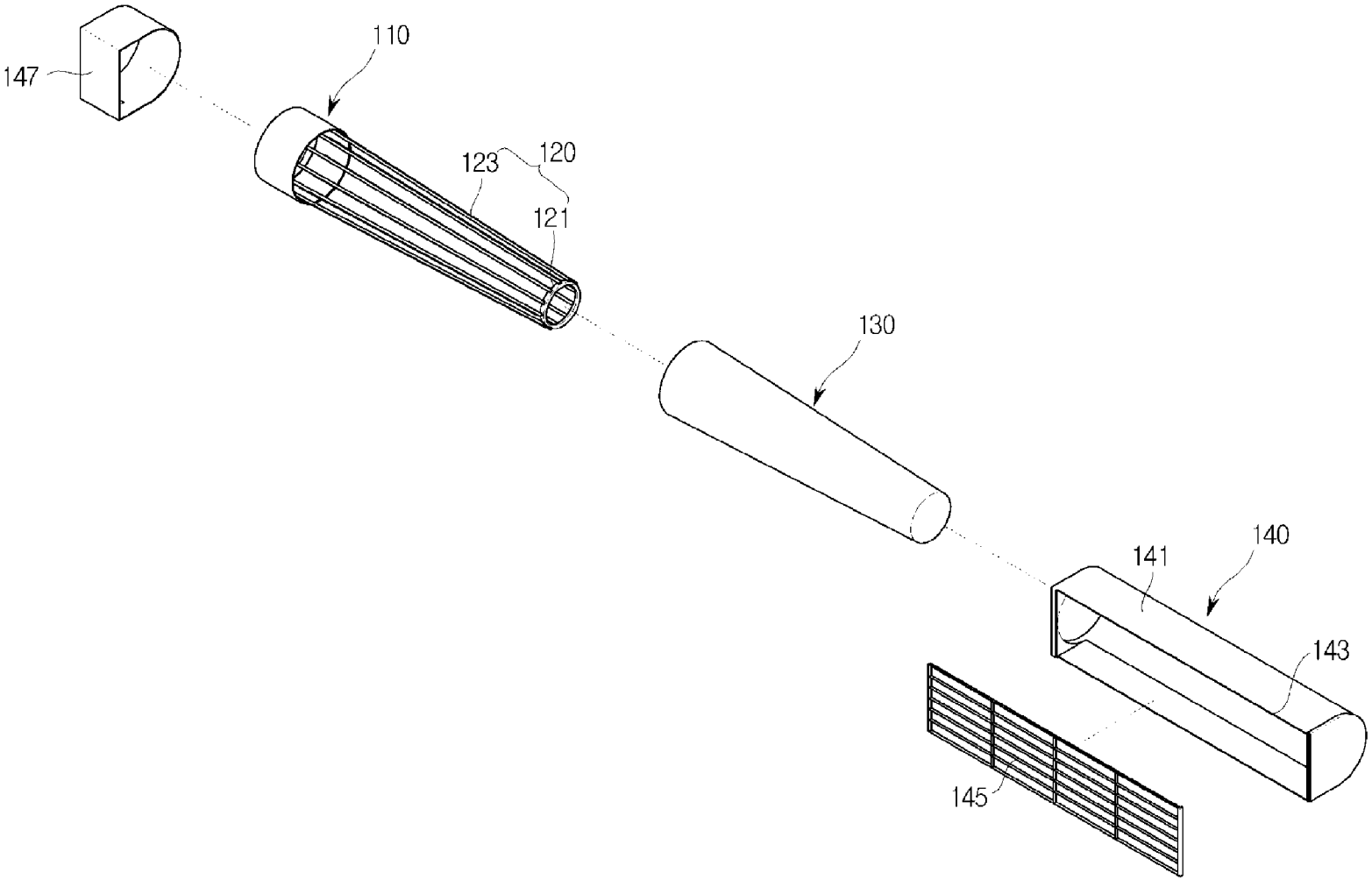
FIG. 3 is an exploded perspective view illustrating a diffuser in accordance with an embodiment.
Figure 4:
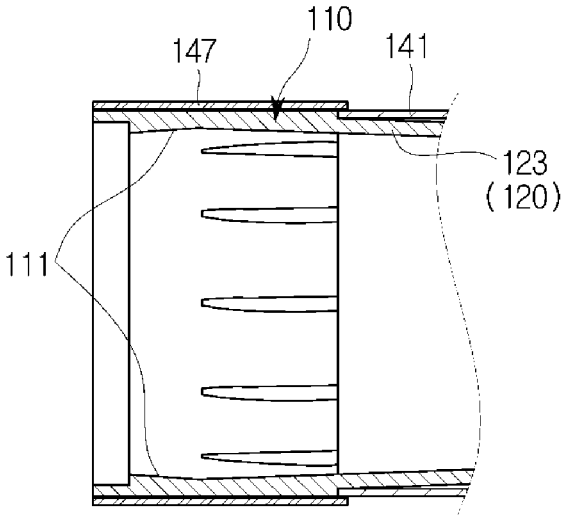
FIG. 4 is a cross sectional view illustrating an expansion part provided at an inner circumferential surface of a diffuser coupling part in accordance with an embodiment.

Referring to FIGS. 2 to 4, the diffuser 100 includes a coupling part 110 coupled to the other side of the supply duct 20, an extension part 120 extending from the coupling part 110, a mesh 130 configured to surround an outer side of the extension part 120, and a housing 140 accommodating the coupling part 110 and the extension part 120.

The coupling part 110 is provided in a hollow cylindrical shape, and coupled to the other side of the supply duct 20.

Cool air discharged from the supply duct 20 is supplied to the extension part 120 by passing through the coupling part 110. In order for the cool air to be gradually diffused while passing through the coupling part 110, the coupling part 110 is provided at an inner circumferential surface thereof with an expansion part 111 that is gradually expanded along a direction of cool being discharged.

As cool air is diffused by the expansion part 111 in the course of passing through the coupling part 110, the discharge speed of cool air is reduced, and noise generated due to a flow of cool air is reduced.

The extension part 120 extends from the coupling part 110 in a taper shape, to guide cool air supplied through the supply duct 20 to the indoors.

The extension part 120 includes a ring member 121 provided in a circular shape having a radius smaller than an inner diameter of the coupling part 110 while being spaced apart from the coupling part 110, and a plurality of connecting bars 123 connecting the coupling part 110 to the ring member 121 such that the extension part 120 extends in the form of being tapered from the coupling part 110.

The plurality of connecting bars 123 are spaced apart from each other, so that cool air discharged from the supply duct 20 and guided to the extension part 120 is discharged to the outside of the extension part 120 through gaps between the plurality of connecting bars 123, and the cool air discharged to the outside of the extension part 120 is supplied to the indoors.

Since the extension part 120 extends in a shape tapered from the coupling part 120, and a cross section of a space between the coupling part 110 and the ring member 121 is gradually decreased along a moving direction of cool air.

Cool air passing through the coupling part 110 moves to the inside of the extension part 120 toward the ring member 121, and is discharged to the outside of the extension part 120 by passing through gaps between the plurality of connecting bars 123.

If the extension part 120 extends along a direction of cool air moving while having the same cross section, the speed of cool air moving along the inside of the extension part is gradually decreased.

When the speed of cool air moving in the extension part 120 is gradually decreased, pressure is getting increased, so that pressure applied to the cool air flowing in the extension part 120 is gradually increased.

Accordingly, cool air discharged from an end of the extension part 120 to the outside of the extension part 120 after moving along the inside of the extension part 120 is given a pressure greater than that of cool air discharged to the outside of the extension part 120 instantly after passing through the coupling part 110.

Since cool air discharged from an end of the extension part 120 to the outside of the extension part 120 is given a pressure greater than that of cool air discharged to the outside of the extension part 120 instantly after passing through the coupling part 110, cool air is discharged faster to the outside of the extension part as the cool air approaches the end of the extension part 120.

As described above, when a flow of cool air is not uniform inside the extension part 120, noise generated when cool air is discharged to the outside of the extension part 120 is increased.

However, according to the present disclosure, the extension part 120 is provided to have a cross section getting decreased along a direction of cool air moved, so that the speed of cool air moving along inside the extension part 120 is uniformly maintained.

Accordingly, the pressure applied to cool air being discharged from the end portion of the extension part 120 to the outside of the extension part 120 after moving along the inside of the extension part 120 is decreased, and thus the cool air discharged to the outside of the extension part 120 instantly after passing through the coupling part 110 is given a substantially same pressure as that of the cool air discharged from the end of the extension part 120 to the outside of the extension part 120. Accordingly, the speed of cool air discharged is substantially same over the entire area of the extension part 120.

As described above, as the flow of cool air inside the extension part 120 is uniformly distributed, noise generated when cool air is discharged to the outside of the extension part 120 is reduced.

The mesh 130 has a predetermined air permeability, and is configured to surround an outer side of the extension part 120 to pressurize cool air moving along inside the extension part 120, thereby reducing noise due to collision of flow of cool air.

The mesh 130 is supported by the plurality of connecting bars 123 of the extension part 120, and configured to pressurize cool air moving along inside the extension part 120 such that cool air receives a lowered pressure at the end portion of the extension part 120 having a tapered shape.

Accordingly, as described above, the speed of cool air discharged to the outside of the extension part 120 becomes substantially same, and the flow of cool air inside the extension part 120 is uniformly distributed, so that noise generated when cool air is discharged is reduced.

The housing 140 accommodates the coupling part 110, the extension part 120 and the mesh 130, and includes an accommodating part 141 configured to accommodate the extension part 120 and the mesh 130 and a cover 147 configured to accommodate the coupling part 110.

An opening 143 is provided at one side of the accommodating part 141, and a discharge grill 145 is provided at the opening 143.

Since the opening 143 is provided at one side of the accommodating part 141, cool air discharged to the outside of the extension part 120 after being supplied by the supply duct 20 is discharged to the indoors is discharged in one direction through the opening 143.

Since the opening 143 provided at the accommodating part 141 induces cool air to be discharged in one direction, the diffuser 100 may serve as an indoor unit.

Although not shown, if the structure of the discharge grill 145 is changed, the discharge direction and flow rate of cool air discharged to the indoors may be adjusted.

The cover 147 accommodates the coupling part 110, and is provided such that cool air discharged from the supply duct 20 is transferred to the coupling part 110 while maintaining a constant discharge direction.

The cover 147 is provided such that cool air discharged from the supply duct 20 is transferred to the coupling part 110 while maintaining a constant discharge direction as the supply duct 20 supplying cool air to the indoors is connected at a corner of the indoor space as shown in FIG. 1, in which the diffuser 100 is disposed at a corner of the indoor space.

Referring to FIG. 5, the supply duct 20 supplying cool air to the indoors is connected to a middle portion of a wall other than a corner of indoors, the diffuser is disposed to protrude from the middle portion of the wall, which degrades the esthetic quality of the air conditioner.

Figure 6:
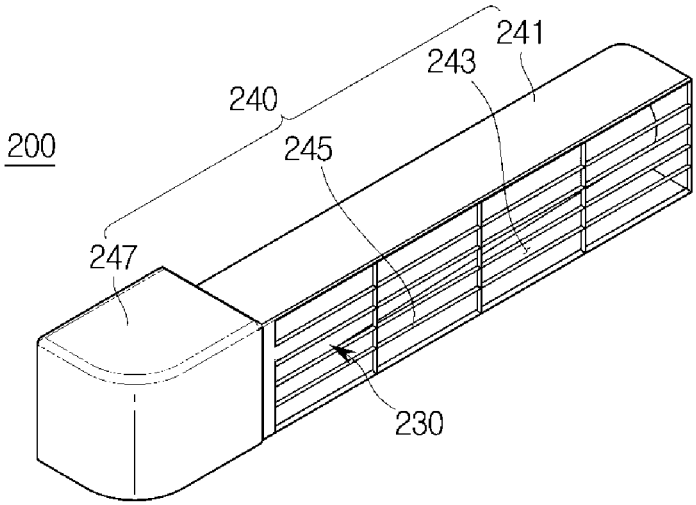
FIG. 6 is a perspective view illustrating a diffuser in accordance with an embodiment.
Figure 7:
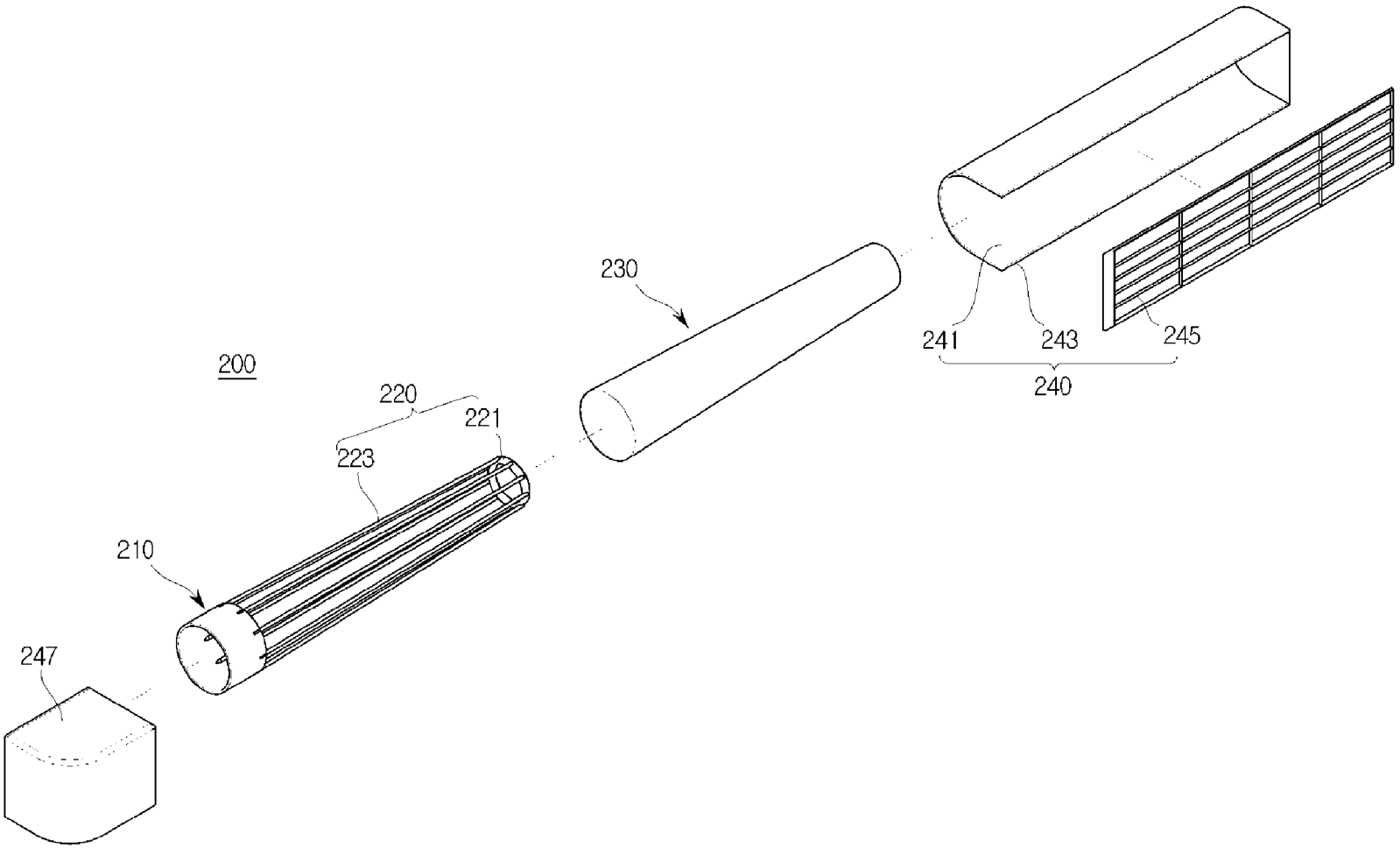
FIG. 7 is an exploded perspective view illustrating a diffuser in accordance with an embodiment.

Accordingly, referring to FIGS. 5 to 7, a cover 247 is provided in a vertically bent shape such that cool air discharged from the supply duct 20 is transferred to a coupling part 210 in a vertically bent direction.

Since the cover 247 is provided in a vertically bent shape, a diffuser 200 is disposed while coming into close contact with the wall.

The coupling part 210, an extension part 220 including a ring member 221 and a plurality of connecting bars 223, a mesh 230, and a housing 240 including an accommodating part 241, an opening 243 and a discharge grill 245 are identical to those described above with reference to FIGS. 1 to 4, and details description thereof will be omitted.

Although a few embodiments have been shown and described on a diffuser and an air conditioner having the same in relation to a specific shape and direction, it would be appreciated by those skilled in the art that changes may be made in these embodiments without departing from the principles and spirit of the disclosure, the scope of which is defined in the claims and their equivalents.

What is claimed is:

1. An air conditioner comprising:

a body provided outdoors to generate cool air;

a diffuser provided indoors to reduce noise generated due to a flow of cool air being discharged indoors; and a supply duct having one end connected to the body and the other end connected to the diffuser so that the cool air generated from the body is supplied indoors, wherein the diffuser comprises:

a coupling part coupled to the supply duct, the coupling part provided with an expansion part at an inner circumferential surface of the coupling part and configured to gradually expand in a direction of cool air being discharged so that cool air discharged from the supply duct is gradually diffused while passing through the coupling;

an extension part which extends from the coupling part and which has a taper shape so that cool air supplied through the supply duct is guided to the indoors;

a mesh which surrounds an outer side of the extension part; and a housing which accommodates the coupling part and the extension part, and which has an opening configured to discharge the cool air supplied to the extension part to the indoors.

2. The air conditioner of claim 1, wherein the coupling part is provided in a hollow cylindrical shape.

3. The air conditioner of claim 2, wherein the extension part includes a ring member which has a circular shape having a radius smaller than an inner diameter of the coupling part and which is spaced apart from the coupling part, and the extension part includes a plurality of connecting bars which connect the coupling part to the ring member to support the mesh.

4. The air conditioner of claim 3, wherein the plurality of connecting bars are spaced apart from each other so that air discharged from the supply duct and guided to the extension part is discharged to the outside of the extension part through gaps between the plurality of connecting bars.

5. The air conditioner of claim 4, wherein the extension part has a cross section that decreases along a moving direction of cool air discharged from the supply duct, so that a flow of cool air inside the extension part is uniformly distributed.

6. The air conditioner of claim 5, wherein as the flow of cool air inside the extension part is uniformly distributed, which causes a speed of cool air discharged from the extension part to decrease, thereby reducing noise generated when cool air is discharged.

7. The air conditioner of claim 2, wherein the housing comprises an accommodating part configured to accommodate the extension part, and a cover disposed at a front side of the accommodating part to accommodate the coupling part.

8. The air conditioner of claim 7, wherein the opening is provided at the accommodating part, and a discharge grill is provided at the opening.

9. The air conditioner of claim 8, wherein the opening is configured to induce air supplied through the supply duct to be discharged in one direction to the outside of the extension part when the air is discharged to the indoors.

10. The air conditioner of claim 7, wherein the cover is provided so that air discharged from the supply duct is transferred to the coupling part while maintaining a constant discharge direction.

11. The air conditioner of claim 7, wherein the cover is provided in a vertically bent shape such that air discharged from the supply duct is transferred to the coupling part in a vertically bent direction.

12. The air conditioner of claim 1, wherein cool air flowing inside the extension part is pressurized by the mesh, so that noise due to collision of flow of cool air is reduced.

13. An air conditioner comprising:

a body provided outdoors to generate cool air;

a diffuser provided indoors to reduce noise generated due to a flow of cool air being discharged to the indoors; and a supply duct having one end connected to the body and the other end connected to the diffuser so that the cool air generated from the body is supplied to the indoors, wherein the diffuser comprises:

a coupling part having a hollow cylindrical shape is coupled to the supply duct and is provide at an inner circumferential surface with an expansion part that gradually expands in a direction of cool air discharged, so that cool air discharged from the supply duct is gradually diffused while passing through the coupling part;

an extension part which extends from the coupling part and which has a taper shape so that a cross section of the extension part decreases along a moving direction of cool air discharged from the supply duct;

a mesh which surrounds an outer side of the extension part; and a housing which has an opening allowing cool air discharged from the extension part to be discharged in one direction.

14. The air conditioner of claim 13, wherein the extension part includes a ring member which has a circular shape having a radius smaller than an inner diameter of the coupling part and which is spaced apart from the coupling part, and the extension part includes a plurality of connecting bars which connect the coupling part to the ring member to support the mesh.

15. The air conditioner of claim 13, wherein cool air flowing in the extension part is pressurized by the mesh, so that noise due to collision of flow of cool air is reduced.

16. The air conditioner of claim 13, wherein the housing comprises an accommodating part configured to accommodate the extension part and provided with the opening, and a cover disposed at a front side of the accommodating part to accommodate the coupling part.

17. A diffuser coupled to a supply duct configured to discharge cool air to reduce noise generated due to a flow of cool air being discharged from the supply duct, the diffuser comprising:

a coupling part having a hollow cylindrical shape and coupled to the supply duct and is provided at an inner circumferential surface with an expansion part that gradually expands in a direction of cool air being discharged so that cool air discharged from the supply duct is gradually diffused while passing through the coupling part;

an extension part which extends from the coupling part and which has a taper shape so that a cross section of the extension part decreases along a moving direction of cool air received from the supply duct;

a mesh which surrounds an outer side of the extension part; and a housing having an opening configured to discharge cool air discharged from the extension part in one direction.

18. The diffuser of claim 17, wherein the extension part includes a ring member which has a circular shape having a radius smaller than an inner diameter of the coupling part and which is spaced apart from the coupling part, and the extension part includes a plurality of connecting bars which connects the coupling part to the ring member to support the mesh.

19. The air conditioner of claim 17, wherein cool air flowing in the extension part is pressurized by the mesh, so that noise due to collision of flow of cool air is reduced.

20. The air conditioner of claim 17, wherein the housing comprises an accommodating part configured to accommodate the extension part, and a cover disposed at a front side of the accommodating part to accommodate the coupling part.

* * * * *